United States Patent [19]

Porter

[11] 4,371,200

[45] Feb. 1, 1983

[54] WIRE GATE LATCH

[76] Inventor: Thomas M. Porter, Halliday, N. Dak. 58636

[21] Appl. No.: 225,620

[22] Filed: Jan. 16, 1981

[51] Int. Cl.³ ..... E05C 3/12

[52] U.S. Cl. ..... 292/99; 292/127; 292/129; 292/DIG. 4

[58] Field of Search ..... 292/DIG. 4, 127, 129, 292/99, 333, 198, 227, 104

[56] References Cited

U.S. PATENT DOCUMENTS

| | | | |
|---|---|---|---|
| 1,309,310 | 7/1919 | Voight | 292/DIG. 4 |
| 1,755,392 | 4/1930 | Hagstrom et al. | 292/99 |
| 1,904,291 | 4/1933 | Neilson et al. | 292/67 |
| 2,181,393 | 11/1939 | Crooks | 292/99 X |
| 2,294,683 | 9/1942 | Murphy | 292/99 |

*Primary Examiner*—Richard E. Moore

*Attorney, Agent, or Firm*—Schroeder, Siegfried, Vidas, Steffey & Arrett

[57] ABSTRACT

A latch for a barbed wire gate. A swinging hooked latch arm is operated by a novel sliding cam arrangement to effect closure of the latch. A pawl holds the latch arm in the closed position around the gate post. Pulling the gate post further toward the latch releases the pawl permitting spring means to swing the latch arm to the open position.

4 Claims, 13 Drawing Figures

WIRE GATE LATCH

BACKGROUND OF THE INVENTION

Ranches and farms have utilized barbed wire fences for more than a century. The combined advantages of low cost, effectiveness of enclosure and simplicity of installation have kept the barbed wire fence the principal form of field enclosure to date. Although it is common to use swinging gate structures to provide access to enclosures around farm buildings or other areas to which frequent access is desired, such gate structures are not very economical nor are they necessary for barbed wire field enclosures for which access is much less frequent. As an alternative to swinging gates, many ranchers and farmers provide their wire fences with wire gates comprising two adjacent posts, only one of which posts is fixed to the ground. Wire coming from one direction is attached to the stationary post while wire coming from the other direction is attached to the loose post. The two posts may be lashed together with wire windings or with a wire loop, thereby completing the enclosure. To open the gate, the loose post is unlashed and laid down permitting vehicles or animals to be driven through the resulting opening.

Such wire gates, although inexpensive and easy to install, present some problems to the user. Barbed wire windings or loops typically used to fasten the gate posts together present a danger of cutting the user or tearing his clothes. Even if the loop is made of smooth wire, two-handed manipulation of the gate and wire loop is usually necessary in order to open or close the gate, so that there still exists a danger of cuts or clothing damage from the barbed wire of the fence. Furthermore, two-handed operation of the gate usually means that a farmer or rancher using a horse or a two-wheeled vehicle must dismount to open or close the gate.

BRIEF DESCRIPTION OF THE INVENTION

The present invention provides a latch for wire gates which overcomes these problems. The latch structure comprises two arms extending outward from a housing to which they are attached. One of the arms is pivotably mounted in the housing. One or both of the arms has a hook end forming an enclosure for receiving the loose fence post. The pivoting arm swings between an open position which permits insertion of the loose post between the two arms, and a closed position which holds the inserted post in the enclosure formed between the two arms and the housing. A slidable actuating bar within the enclosure formed by the two latch arms is pushed into the housing as the loose post is pulled into the enclosure between the latch arms. A novel mechanism within the housing causes the pivoted latch arm to close around the post as the actuating bar is depressed. The latch is opened by depressing the actuating bar even further into the housing,e.g., by pulling the loose post closer to the fixed post. The latch may therefore be operated with only one hand pulling the loose post toward the latch housing, thus minimizing cutting and tearing risks associated with wire bound wire gates. One-handed operation also permits the user to remain on his horse or motorcycle while opening or closing the gate. Operation of the latch also requires substantially less time than that required to open or close a wire gate held by a wire loop.

The latch device of the present invention may also be utilized as a wire tightener. The device is mounted on the fixed post by means of a threaded rod which extends from the rear of the latch housing and passes through the post. Nuts and washers on either side of the fixed post hold the rods securely to the post. Tightening the rear nut so as to draw the latch toward the fixed post while the loose post is held by the latch will tighten the fence wires attached to the loose post.

Whereas a wire loop hooked over the loose post can only hold that post at a point above the highest fence wire, the latch of the present invention may be mounted to grip the loose post nearer the center thereof, e.g., between the first and the second wires of a three wire fence. This central mounting provides a more uniform tension on the fence wires, thereby minimizing uneven loosening of the fence wires and making opening and closing of the gate easier.

DETAILED DESCRIPTION OF THE INVENTION

Figure 2:
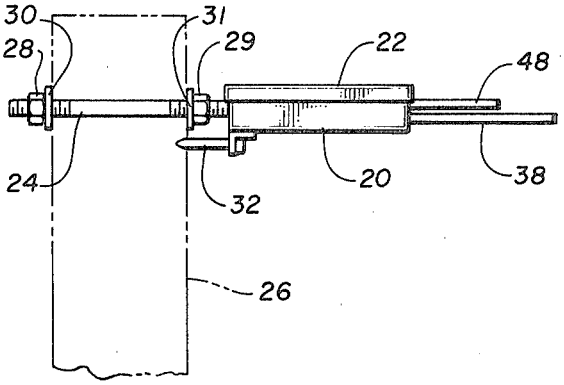
FIG. 2 is a side elevational view of the invention.
Figure 1:
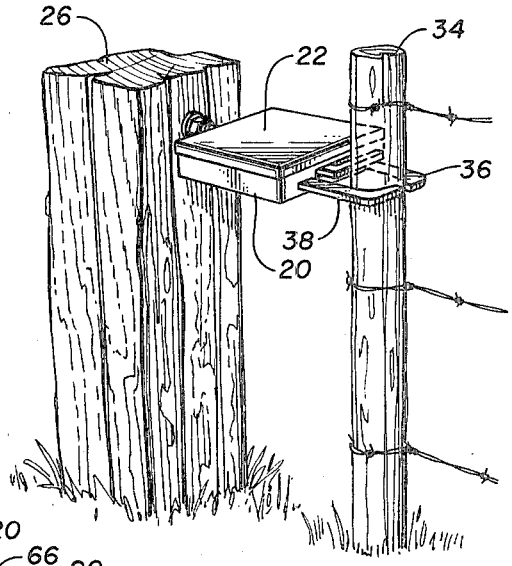
FIG. 1 is a pictorial view of the invention in use with its associated elements.

The housing for the latch of the present invention is designated by the numeral 20. A cover 22 fits over the housing and overlaps the four sides thereof to protect the interior parts from the weather. A threaded rod 24 attached to the housing extends outwardly therefrom and serves to mount the latch on a post 26 which is anchored in the ground. Nuts 28 and 29 and washers 30 and 31 securely hold the rod on post 26. For stability, a second point of attachment is provided by lag screw or spike 32 attached to the bottom of the latch housing and screwed or nailed part way into post 26. Alternatively, spike 32 may be replaced by a second threaded rod which extends all the way through post 26 in the manner of rod 24.

The latch grips loose gate post 34 with hooked arms 36 and 38 which extend outwardly from side 40 of housing 20. Arm 36 extends into the housing through slot 42 and is pivotably mounted to the housing by means of bolt or pin 44. Arm 38 is fixed to the housing and does not move. Slot 42 is of sufficient width to permit movement of arm 36 between the open latch position shown in FIG. 3 and the closed latch position shown in FIG. 4. A protrusion 46 fixed to the bottom of housing 20 serves as a stop arm 36 when the arm is in the open position.

L-shaped actuating bar 48 extends into the enclosure formed by latch arms 36 and 38 at a point slightly higher than that of arms 36 and 38. Bar 48 is slidably carried in guide member 50. Wedge shaped cam 52 which extends out of the side of guide member 50, is attached to arm 48. Spring 54 attached to guide member 50 and to wedge 52 urges bar 48 outwardly from housing 20. provided with a wedge shaped cam follower 56 which is pivotably attached to arm 36 by hinge means 58. A leaf spring 60 holds wedge 58 down against arm 36. The interior portion of arm 36 also has a convex surface 62 and a concave notch 64 at the rear end thereof. Arm 36 is also provided with a pin 66 to which one end of spring 68 is attached. The other end of spring 68 is fastened to housing 20 near the rear thereof by means of pin 70. Spring 68 urges arm 36 toward the latch open position.

A pawl 72 is pivotably attached to the housing by hinge pin 74. Compression spring 76 pushes pawl 72 inwardly away from the rear wall of housing 20. The free end of the pawl is curved into a tight loop 78 which can fit into notch 64 on arm 36.

Figure 3:
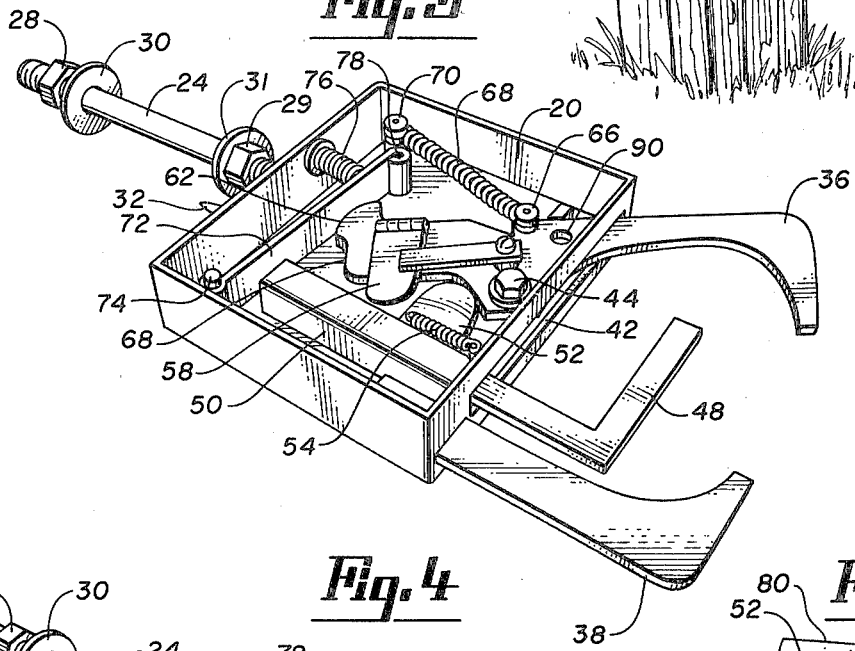
FIG. 3 is a pictorial view of the invention with the cover removed, showing elements in unlatched and opened position.
Figure 4:
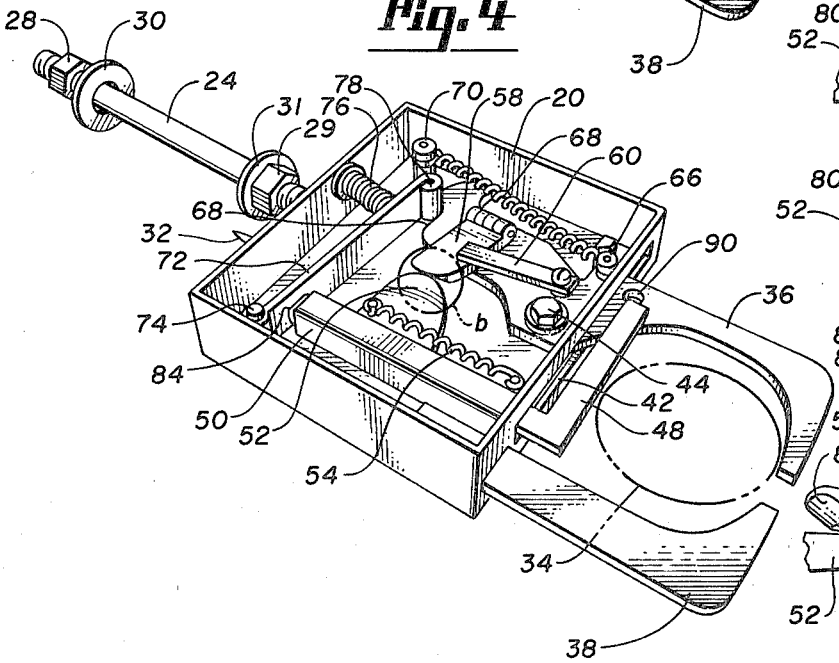
FIG. 4 is a pictorial view of the invention as shown in FIG. 3, but with latch elements in latched and closed position.
Figure 6B:
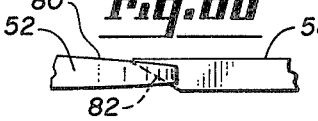
FIG. 6*b* is a side elevational detail of the cam and follower wedges taken along line 6*b*–6*b* of FIG. 6*a*.
Figure 6A:
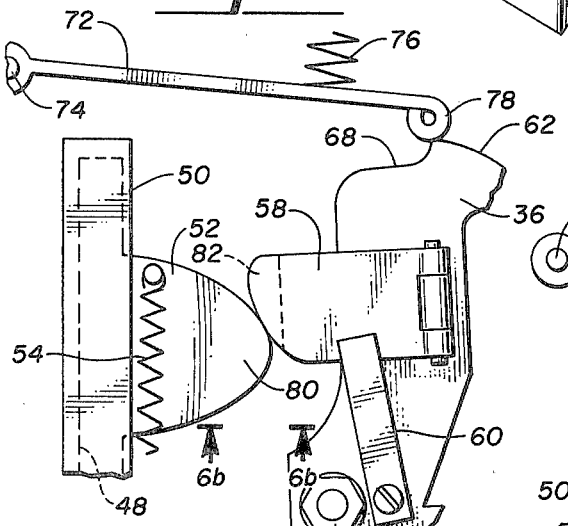
FIG. 6*a* is a top plan detail of the latch elements of FIG. 3 with the sliding cam wedge engaging the cam follower wedge on the pivoted latch arm.

When the latch is in the open position shown in FIG. 3, springs 54, 68 and 76 are most relaxed. To close the latch around post 34, the post is pulled into the opening between arms 36 and 38. When the post is pulled into this opening, bar 48 is pushed into housing 20. As bar 48 is slid into housing 20, cam 52 drives cam follower 58 rearward causing arm 36 to pivot closed. The curved surface 62 of latch arm 36 engages pawl 72 as arm 36 pivots closed (see FIGS. 6*a* and 6*b*). When notch 64 reaches end loop 78, spring 76 drives the pawl 72 into notch 64 holding arm 36 in the latched position.

Figure 7B:
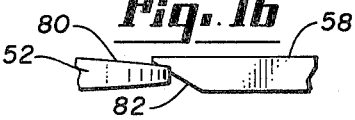
FIG. 7*b* is the same view as FIG. 6*b* taken along lines 7*b*—7*b* of FIG. 7*a*.
Figure 8B:
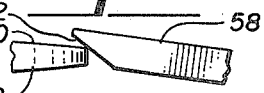
FIG. 8*b* is the same view as 6*b* taken along lines 8*b*—8*b* of FIG. 8*a*.
Figure 9B:
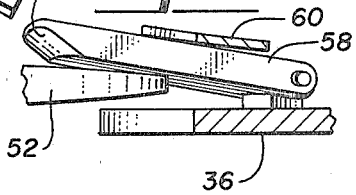
FIG. 9*b* is a side elevation detail partly in section taken along line 9*b*—9*b* of FIG. 9*a*.
Figure 7A:
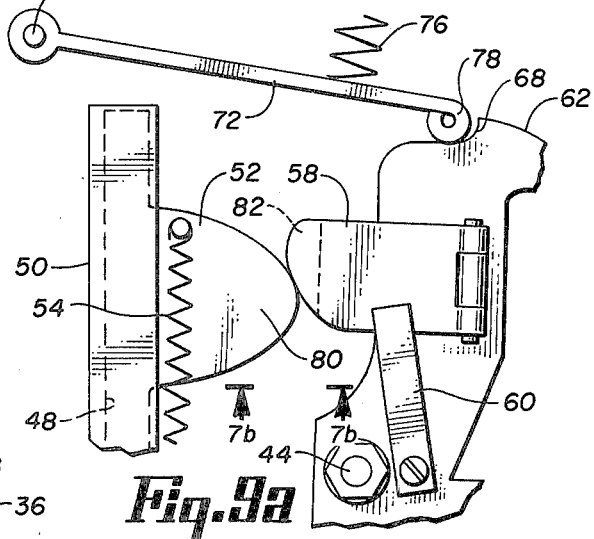
FIG. 7*a* is the same view as FIG. 6*a* but with the actuating bar and latch arm advanced to overlatch stage.
Figure 8A:
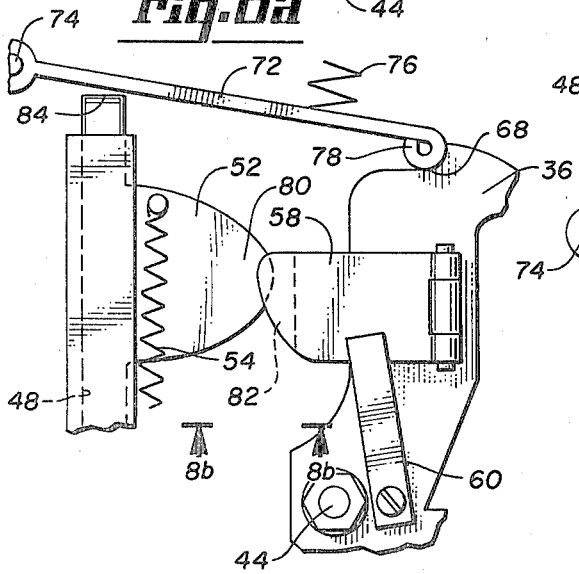
FIG. 8*a* is the same view as 6*a* but with actuating bar and latch arm advanced to point at which the cam follower disengages the cam by overriding same.

Further depression of bar 48, e.g., by pulling post 34 further towards post 26, releases the latch. The mechanism for this release is detailed in FIGS. 7, 8 and 9. FIGS. 7*b*, 8*b* and 9*b* show side views of wedges 52 and 58, corresponding to the respective top views shown in FIGS. 7*a*, 8*a* and 9*a*. FIG. 7*a* shows the position of wedges 52 and 58 as arm 48 is depressed slightly beyond the latch position. Latch arm 38 continues to rotate as wedge 52 pushes against wedge 58. However, as shown in FIG. 7*b*, wedge 58 begins to ride above wedge 52 against leaf spring 60. The upward motion of wedge 58 is facilitated by tapered upper surface 80 of wedge 52 and tapered lower surface 82 of wedge 58. Further depression of the actuating bar causes wedge 58 to rise completely over wedge 52. When this occurs, arm 36 ceases to be affected by further movement of bar 48 and spring 68 draws arm 36 back to the latched position (FIG. 8*a*).

Figure 5:
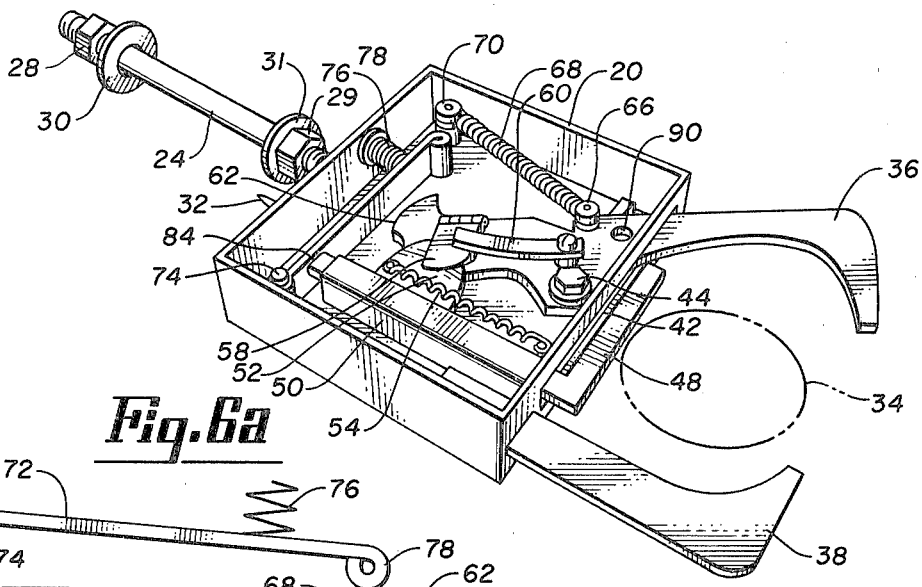
FIG. 5 is a pictorial view of the invention as shown in FIGS. 3 and 4, but with the latch actuating bar having depressed the pawl allowing latch to discharge.
Figure 9A:
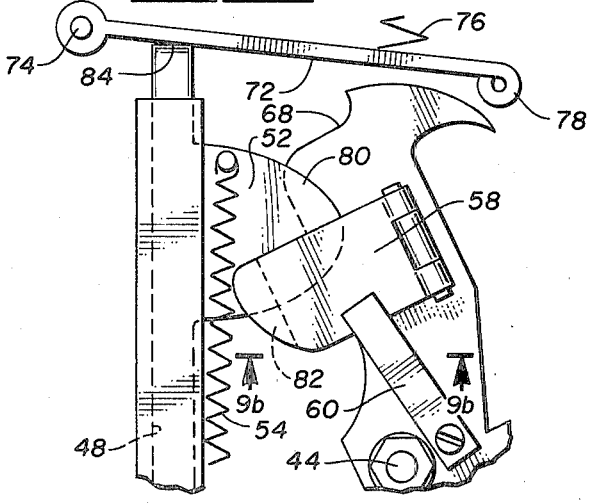
FIG. 9*a* is the same view as 6*a*, but with the actuating bar fully depressed to release the latch arm.

Still further depression of the trigger arm results in rear portion 84 of arm 48 coming in contact with pawl 72 and pushing the pawl out of notch 64 (FIG. 9*a*). Spring 68 then pulls arm 36 to the open position as shown in FIG. 5. As the post is removed from the latch enclosure, trigger arm 48 is returned to its rest position by spring 54. Wedge 58 drops back against arm 36 when wedge 52 has passed out from under it, thus returning the latch to the configuration of FIG. 3.

The latch device of the present invention may be provided with a hole 90 through arm 36. A padlock passed through hole 90 will lock the device by preventing arm 36 from returning to the open position.

The latch of the present invention may also be used as a fence wire tightener. To do so, the latch is closed on post 34 and nut 29 is loosened. Tightening nut 28 against post 26 wil draw post 34 toward post 26, thereby tightening the wires attached to post 34.

What is claimed is:

1. A wire gate latch comprising:

a housing having a horizontal slot through one side thereof;

means for mounting said housing to a fixed post;

a first arm extending outwardly from said slotted side of the housing;

a second arm, pivotably mounted in said housing and extending outwardly through said slot, said second arm having a hooked end extending toward said first arm and further having a first position wherein said arms and housing side define an enclosure for engaging a post, and a second position pivotably displaced further from said first arm than said first position, whereby an opening is formed in said enclosure for receiving or releasing said post;

a slidable actuating bar within said enclosure extending into said housing;

first spring means associated with said actuating bar for urging said bar outwardly from said housing into said enclosure;

cam means within the housing associated with said actuating bar for moving said second arm from the second position to the first position when the actuating bar is partially depressed into the housing;

pawl means associated with a notch in the second arm for retaining the second arm in the first position, said pawl means in cooperative alignment with the actuating bar such that the actuating bar releases said pawl means from said notch when the bar is depressed further into the housing; and second spring means associated with said second arm for urging the second arm toward the second position when said pawl means is released from said notch.

2. A latch as in claim 1 wherein said mounting means includes an elongated threaded rod.

3. A latch as in claim 1 wherein said cam means comprises:

a wedge shaped sliding cam surface attached said actuating bar, said wedge shaped cam having an upper surface tapered downward towards the tip thereof;

a wedge shaped cam follower hinged to the upper surface of said second arm, said cam follower having a lower surface tapered upwardly toward the tip thereof; and spring means associated with said cam follower for urging said cam follower against said second arm, said cam and cam follower aligned such that when said actuating bar has been partially depressed and said pawl means has engaged the notch in said second arm, said cam follower overrides the cam thereby disengaging the second arm from the actuating bar.

4. A latch as in claim 1 wherein said second arm includes a hole therethrough, located adjacent to the outside of said housing when said arm is in the first position, whereby the latch may be locked in the first position when a padlock is passed through said hole.

* * * * *

UNITED STATES PATENT AND TRADEMARK OFFICE

CERTIFICATE OF CORRECTION

PATENT NO. : 4,371,200

DATED : February 1, 1983

INVENTOR(S) : Thomas M. Porter

It is certified that error appears in the above-identified patent and that said Letters Patent are hereby corrected as shown below:

Column 3, line 18, before "provided" insert - The portion of arm 36 inside housing 20 is -

Column 4, line 8, delete "wil" and insert - will -

Signed and Sealed this

*Twelfth* Day of *July 1983*

[SEAL]

*Attest:*

GERALD J. MOSSINGHOFF

*Attesting Officer*

*Commissioner of Patents and Trademarks*